US005953777A

United States Patent [19]

Buck

[11] Patent Number: 5,953,777

[45] Date of Patent: Sep. 21, 1999

[54] ADJUSTABLE PILLOW

[76] Inventor: Ronald Mark Buck, 423 Pacific, Solana Beach, Calif. 92075

[21] Appl. No.: 09/036,368

[22] Filed: Mar. 6, 1998

[51] Int. Cl.[6] ..... A47G 9/00

[52] U.S. Cl. ..... 5/636; 5/644; 5/490

[58] Field of Search ..... 5/636, 640, 644, 5/722, 723, 490

[56] References Cited

U.S. PATENT DOCUMENTS

| | | | |
|---|---|---|---|
| 247,892 | 10/1881 | Doremus . | |
| 395,043 | 12/1888 | Doremus . | |
| 848,437 | 3/1907 | Brown | 5/723 X |
| 2,884,652 | 5/1959 | Paolicelli | 5/490 X |
| 3,148,389 | 9/1964 | Lustig | 5/645 |
| 3,216,028 | 11/1965 | Lawson | 5/337 |
| 3,243,828 | 4/1966 | McCarty | 5/636 |
| 3,319,272 | 5/1967 | Eller | 5/636 X |
| 3,763,509 | 10/1973 | Mittendorf | 5/341 |
| 3,775,785 | 12/1973 | Mittendorf | 5/341 |
| 4,274,673 | 6/1981 | Kifferstein | 297/220 |
| 4,393,530 | 7/1983 | Stark | 5/437 |
| 4,424,600 | 1/1984 | Callaway | 5/470 |
| 4,508,044 | 4/1985 | Downey et al. | 112/262.2 |
| 4,649,582 | 3/1987 | Cho | 5/434 |
| 4,756,035 | 7/1988 | Beier | 5/437 |
| 4,829,614 | 5/1989 | Harper | 5/436 |
| 4,908,894 | 3/1990 | Sanders | 5/436 |
| 4,916,765 | 4/1990 | Castronovo, Jr. | 5/437 |
| 4,959,880 | 10/1990 | Tesch | 5/434 |
| 5,016,303 | 5/1991 | Tanaka et al. | 5/437 |
| 5,127,117 | 7/1992 | Bridges | 5/636 |
| 5,138,732 | 8/1992 | Wattie et al. | 5/636 |
| 5,163,194 | 11/1992 | Dixon | 5/636 |
| 5,168,590 | 12/1992 | O'Sullivan | 5/490 |
| 5,215,815 | 6/1993 | Levy | 428/246 |
| 5,360,017 | 11/1994 | Austin | 128/845 |
| 5,528,784 | 6/1996 | Painter | 5/640 |
| 5,642,543 | 7/1997 | Huntley | 5/640 |

*Primary Examiner*—Michael F. Trettel
*Attorney, Agent, or Firm*—Baker & Maxham

[57] ABSTRACT

An adjustable pillow includes a stretchable pillow case having a plurality of removable pillow layer inserts. The pillow layer inserts come in various thicknesses and firmness to permit adjustment for overall pillow height, overall firmness, and surface firmness upon insertion into the pillow case. The total height of the pillow depends on the total height of the various inserts being used, the overall firmness depends on whether the inserts are soft, medium, or hard, and the surface firmness depends on the firmness of the topmost inside layer. The inserts adjust across the entire length and width of the pillow so that a sleeper will not experience changing height or firmness while sleeping. The adjustable pillow can be used in combination with a conventional pillow by placing the conventional pillow inside the stretchable pillow case and selectively adding the removable inserts as desired.

13 Claims, 2 Drawing Sheets

ADJUSTABLE PILLOW

BACKGROUND OF THE INVENTION

1. Field of the Invention

The invention relates generally to cushions or pillows and, more particularly, to pillows with adjustable layers or inserts.

2. Description of the Related Art

People have different preferences for firmness and height of pillows. Some people are more comfortable and sleep better using a pillow that is relatively soft, while others prefer a pillow that is more firm. Similarly, some people prefer a relatively high, tall pillow while others are more comfortable with a relatively flat pillow. Some users might even want a pillow of a particular height and firmness part of the time and of a different height and/or firmness another time. Thus, it would be advantageous for a pillow to be adjustable in firmness and height, and various attempts have been made to provide such flexibility.

For example, U.S. Pat. No. 4,959,880 to Tesch describes a pillow with a removable filling component that changes the hardness of the pillow.

Some pillows have segmented sections, each of a different firmness or size. Adjustability is typically achieved by moving the pillow so that the appropriate section is directly underhead, leaving the undesired sections still attached but moved away from the head of the user. U.S. Pat. No. 395,043 to Doremus and U.S. Pat. No. 3,216,028 to Lawson describe segmented pillows. Some people have a physical malady that makes an adjustable pillow desirable, such as an orthopedic or therapeutic pillow. A therapeutic pillow is described, for example, in U.S. Pat. No. 4,908,894 to Sanders and a therapeutic pillow cover is described in U.S. Pat. No. 5,168,590 to O'Sullivan.

A symmetric distribution of firmness and size across the volume of a pillow are usually desired. Unfortunately, the adjustable pillows described can have an asymmetric distribution of firmness and height, so that a user might experience different firmness and height across the sleeping area of the pillow.

Pillows can be quite expensive and therefore it would be advantageous if conventional pillows that have lost their shape, size, or firmness could be restored without the expense of purchasing a replacement pillow. Unfortunately, most pillows with removable inserts are not compatible with existing conventional pillows. Thus, the feature of adjustability could be gained only by entirely replacing a pillow.

The above-referenced U.S. Pat. No. 5,168,590 to O'Sullivan describes a pillow cover that uses pads asymmetrically positioned about the cover to provide adjustment. U.S. Pat. No. 4,508,044 to Downey et al. describes a pillow cover that is wrapped around a deteriorated pillow and sewn shut.

From the discussion above, it should be apparent that there is a need for an easily adjustable pillow cover that can be used with a conventional pillow and provides different firmness and thickness across the entire sleeping area of the pillow. The present invention satisfies this need.

SUMMARY OF THE INVENTION

The present invention provides an adjustable pillow that includes a stretchable pillow case having a plurality of removable pillow layer inserts. The stretchable pillow case shrinks or expands depending on the number of inserts and the overall height of the pillow. The stretchable pillow case also securely holds the various independent inserts together such that they act as one complete unit. The pillow layer inserts come in various thicknesses and firmness, such as soft, medium, and hard. The removable inserts permit the pillow to be adjusted for height, overall firmness, and surface firmness. The total height of the pillow will depend on the total height of the various inserts being used, the overall firmness will depend on whether the inserts are soft, medium, or hard, and the surface firmness will depend on the firmness of the topmost insert. The inserts advantageously extend across the entire length and width of the pillow. In this way, a sleeper will not experience changing height or firmness while sleeping, but can uniformly adjust the height and firmness of the pillow. A lengthwise seal, such as a zipper, facilitates placement of the inserts.

The adjustable pillow is compatible with conventional pillows. In particular, the adjustable pillow can be used in combination with a conventional pillow, for pillow restoration, or simply to provide the adjustability feature to a conventional pillow. A user simply places the conventional pillow inside the stretchable pillow case of the adjustable pillow and selectively adds the removable inserts as desired. In this way, a user can gain an adjustable pillow without completely replacing a conventional pillow.

Other features and advantages of the present invention should be apparent from the following description of the preferred embodiment, which illustrates, by way of example, the principles of the invention.

DESCRIPTION OF THE PREFERRED EMBODIMENT

Figure 1:
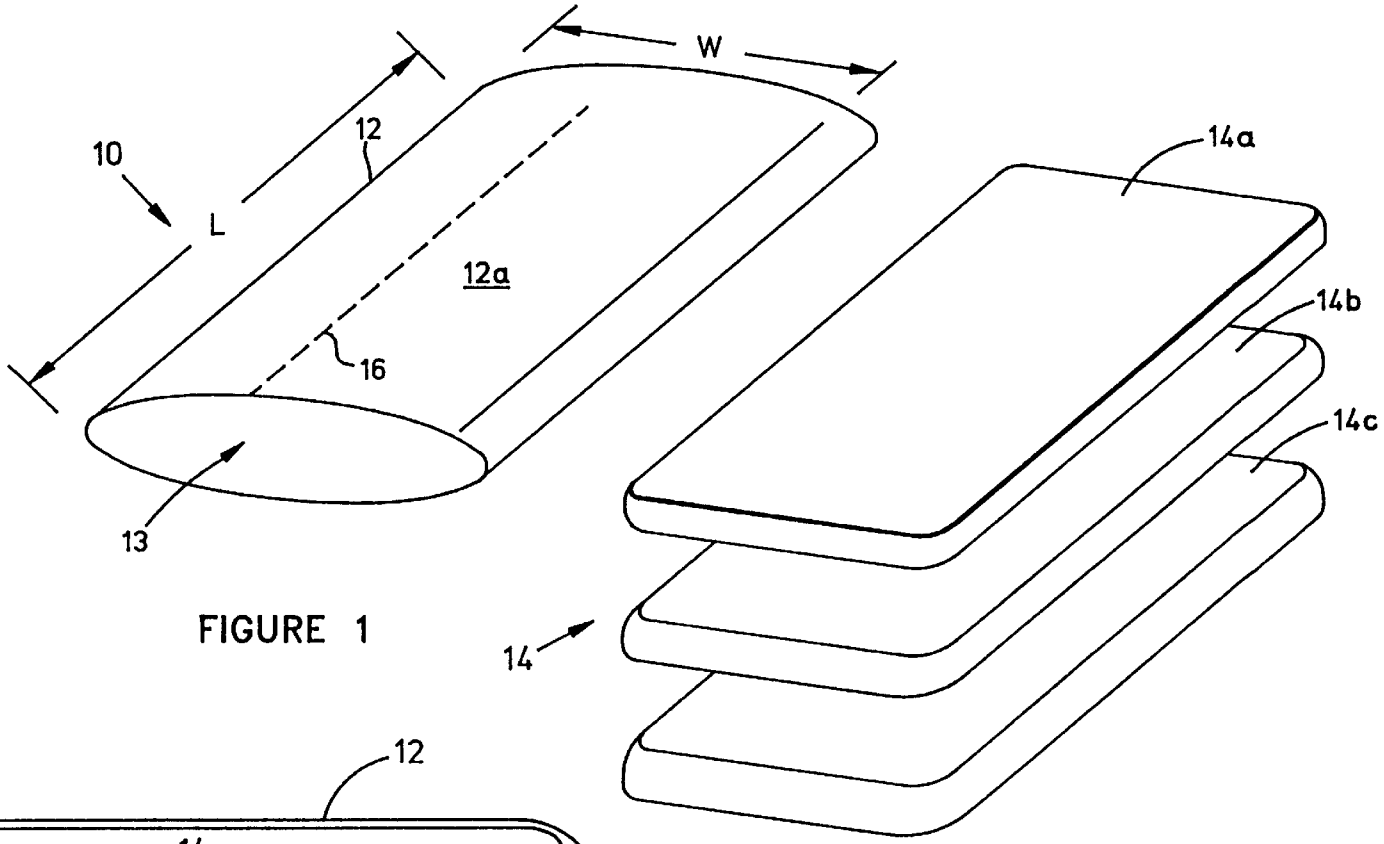
FIG. 1 is an isometric view of an adjustable pillow constructed in accordance with the present invention, showing the inserts removed from the stretchable pillow case.

The invention should be better understood with reference to the following detailed description of the preferred embodiment illustrated in the drawings.

THE ADJUSTABLE PILLOW: PILLOW CASE AND INSERTS

FIG. 1 shows an adjustable pillow 10 constructed in accordance with the present invention. The adjustable pillow 10 comprises a stretchable pillow case 12 and multiple, removable pillow layer inserts 14. References to a particular one of the inserts 14*a*, 14*b*, 14*c* will be made when needed.

References to the inserts 14 will otherwise be understood as references to the inserts collectively. The pillow layer inserts 14 come in various thicknesses and firmness to permit adjustment for overall pillow height, overall firmness, and surface firmness. The total height of the adjustable pillow depends on the total height of the various inserts 14 being used, the overall firmness depends on the firmness of the inserts, and the surface firmness depends on the firmness of the topmost inside layer. The inserts 14 provide adjustment across the entire length and width of the pillow case 12 so that a user will not experience changing height or firmness while sleeping. The adjustable pillow 10 can be used in combination with a conventional pillow by placing the conventional pillow inside the stretchable pillow case 12 and selectively adding the removable inserts 14 as desired.

FIG. 1 shows that the inserts 14 are inserted lengthwise into the pillow case 12 and extend along the entire length and width of the pillow case. The pillow case 12 has an open end 13 through which the inserts are inserted and has a length dimension "L" and a width dimension "W" shown in FIG. 1 that define a sleeping area 12*a* of the pillow 10. The open end of the pillow case 13 may be intersected by a perpendicular zipper 16 that runs substantially the length of the pillow case 12 and when unzipped, further widens the opening, thus creating easy placement of the inserts within the outer pillow case 12. The sleeping area 12*a* is approximately the surface area of the pillow case on which a sleeping person can be expected to rest his or her head. It should be understood that the "height" of the pillow 10 refers to the vertical dimension of the pillow 10 when viewed in cross section, perpendicular to the plane defined by the length and width of the pillow case.

The three pillow layer inserts 14 illustrated in FIG. 1 comprise inserts of different relative firmness and thickness. In particular, a first insert 14*a* is relatively soft and thin while a second insert 14*b* is of medium firmness and thickness, and a third insert 14*c* is relatively hard and relatively thick. The firmness of the inserts does not need to correspond with the thickness as described. As shown in FIG. 1, the pillow 10 nominally includes three inserts 14, but a different number can be provided. Moreover, the inserts can be provided independently of the pillow case 12. That is, pillow users can selectively mix and match the different firmness and thickness varieties of inserts 14 to assemble a group of all soft inserts, all hard inserts, or any combination in between. In addition, the user may determine the overall height of the pillow by the thickness of the various inserts which are selected. In this way, individual users can tailor the pillow 10 to their own preference.

Figure 2:
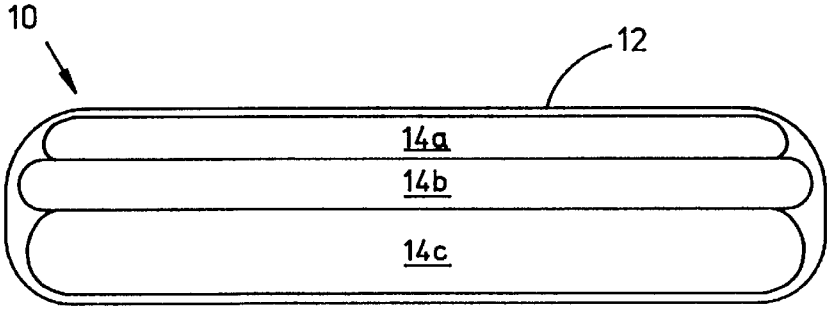
FIG. 2 is a sectional view of the adjustable pillow illustrated in FIG. 1 with the inserts placed in the pillow case. having a different arrangement of inserts to achieve a different total height from that shown in FIG. 2.

FIG. 2 shows the adjustable pillow 10 with the three inserts 14*a*, 14*b*, 14*c* placed in the stretchable pillow case 12 to provide an initial height, overall firmness, and surface firmness. More particularly, the total cross-sectional height of the adjustable pillow as illustrated in FIG. 2 is substantially equal to the combined height of any padding material in the pillow case 12, the height of the first soft insert 14*a*, the height of the second medium insert 14*b*, and the height of the third firm insert 14*c*. The overall firmness of the pillow case 12 with inserts 14*a*, 14*b*, 14*c* is the firmness provided by the three inserts and the pillow case, as indicated by the resistance to "flattening" by the combination. The surface firmness of the pillow case 12 and inserts 14*a*, 14*b*, 14*c* is the perceived firmness to the sleeper. Assuming that the pillow case 12 has no padding material that would substantially alter the perceived firmness of the underlying top-most insert, then the perceived surface firmness would be the firmness of the insert closest to the sleeper's head. In FIG. 2 therefore, the initial surface firmness of the pillow is determined by the firmness of the top-most soft insert 14*a*.

ADJUSTMENT OF THE PILLOW

As noted above, a user can adjust the arrangement of the inserts 14*a*, 14*b*, 14*c* to adjust overall pillow height, overall firmness, and surface firmness.

Adjustment of the Total Height

Figure 3:
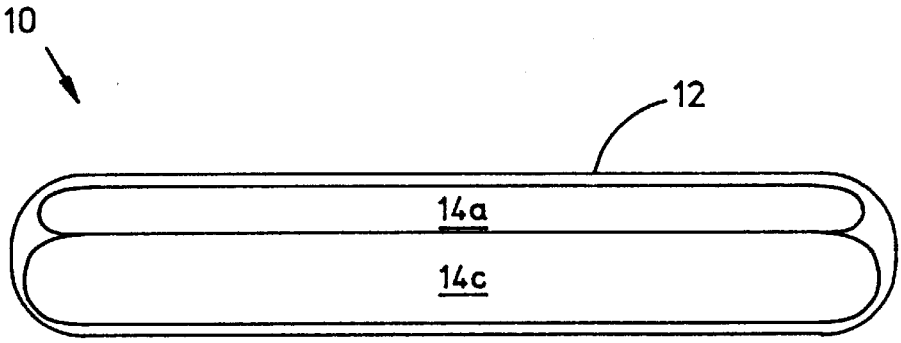
FIG. 3 is a sectional view of the adjustable pillow illustrated in FIG. 1 having a different arrangement of inserts to achieve a different total height from that shown in FIG. 2.

The total height of the adjustable pillow depends on the total height of the various inserts 14 being used. The inserts may all be equally thick or they may vary in their thickness. From a mathematical point of view, a greater number of overall pillow heights is achieved from inserts that vary in their thickness, as opposed to inserts that are all equally thick. FIG. 3 shows the pillow 10 with the medium insert 14*b* removed, leaving only the soft insert 14*a* and the firm insert 14*c* inside and thereby adjusting the overall height of the pillow. Thus, in FIG. 3, the overall height of the pillow is substantially equal to the height of the padding material in the pillow case 12. By removing the medium layer 14*b* and leaving only 14*a* and 14*c* there is a reduction from the overall height for the arrangement illustrated in FIG. 2.

The greatest overall total height is achieved with the greatest number of removable inserts 14 placed within the pillow case 12.

Adjustment of the Surface Firmness

Figure 4:
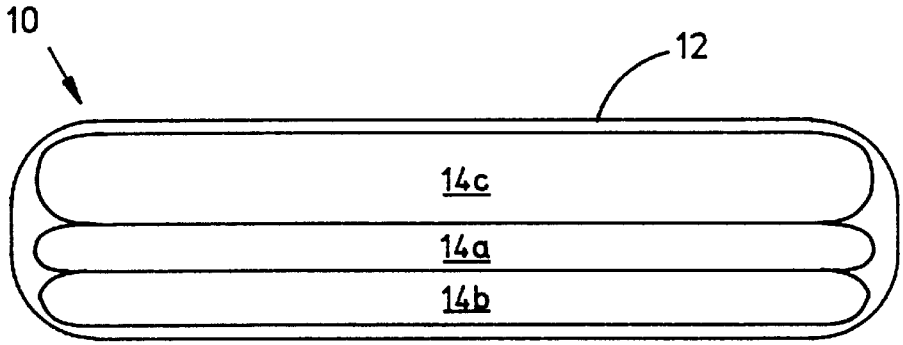
FIG. 4 is a sectional view of the adjustable pillow illustrated in FIG. 1 having a different arrangement of inserts to achieve a different surface firmness from that shown in FIG. 2.

FIG. 4 is a sectional view of the adjustable pillow 10 having a different arrangement of inserts from FIG. 2 so as to achieve a different perceived surface firmness. In particular, FIG. 4 again shows all three inserts 14*a*, 14*b*, 14*c* in the pillow case 12 as in FIG. 2, except that the order is changed so from top to bottom the inserts are firm insert 14*c* first, soft insert 14*a* in the middle, and medium insert 14*b* on the bottom. Thus, the firm insert 14*c* is the topmost insert within the pillow case 12. Accordingly, the perceived surface firmness in the FIG. 4 arrangement will be more firm than the FIG. 2 arrangement.

It should be apparent that the softest perceived surface firmness is obtained if the soft insert 14*a* is placed top-most, the firmest perceived surface firmness is obtained if the firm insert 14*c* is placed top-most, and a medium perceived surface firmness is obtained if the medium insert 14*b* is placed top-most.

Adjustment of Overall Firmness

Figure 5:
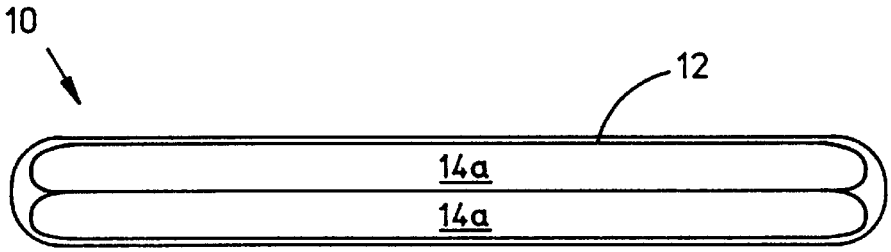
FIG. 5 is a sectional view of the adjustable pillow illustrated in FIG. 1 having a different arrangement of inserts to achieve a different overall firmness from that shown in FIG. 2.

FIG. 5 is a sectional view of the adjustable pillow illustrated in FIG. 1 having a different arrangement of inserts to achieve a different overall firmness from that shown in FIG. 2. The perceived overall firmness of the pillow 10 largely depends on the combination of inserts 14 placed within the pillow case 12. In FIG. 5, two inserts have been placed in the pillow case and both inserts are the softest insert 14*a*. Thus, both the number and type of inserts can be adjusted to adjust the perceived overall firmness (and height and surface firmness) of the pillow.

The perceived overall firmness will be softer for the FIG. 5 arrangement as compared to the FIG. 2 arrangement and the FIG. 4 arrangement, both of which have one of each type of insert in the pillow case 12.

Although the overall surface firmness of the arrangements shown in FIG. 2 and FIG. 4 will be much closer to each other (and firmer) than to the arrangement shown in FIG. 5, it should be apparent that the perceived overall firmness of the pillow 10 depends not only on the combination of the different insert firmness, but also to a lesser extent on the surface firmness. That is, the perceived overall firmness of the pillow will change somewhat depending on the ordering of the inserts in the pillow case 12. Accordingly, the perceived overall firmness of the FIG. 4 arrangement will be different from the perceived overall firmness of the FIG. 2 arrangement, even though both arrangements include all three inserts. In particular, the perceived overall firmness of FIG. 4 should be somewhat more firm than FIG. 2.

COMBINATION WITH CONVENTIONAL PILLOW

Figure 6:
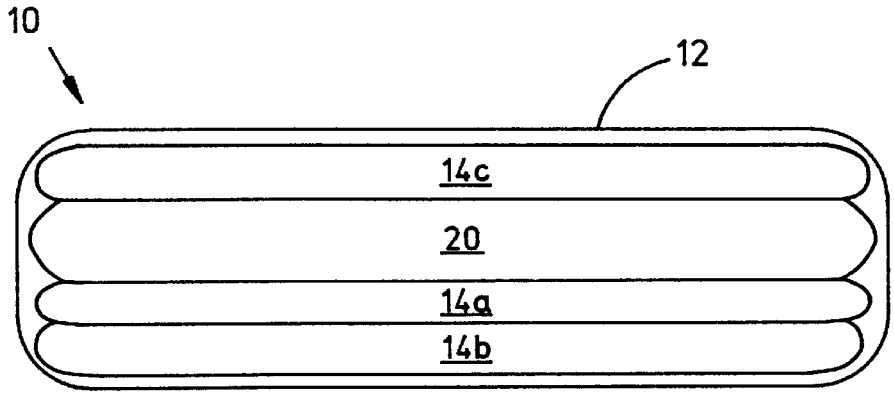
FIG. 6 is a sectional view of the adjustable pillow illustrated in FIG. 1, in combination with a conventional pillow.

As noted above, the adjustable pillow 10 can be used in combination with a conventional pillow to provide adjustability that otherwise would be lacking. Conventional pillows often become flat and lose their height due to the constant weight and pressure of the head upon the pillow surface. Pillows are often thrown away due to wear and tear. By adding inserts 14 to an old pillow, the pillow can be restored to an original or preferred pillow height. Often the users of conventional pillows become attached to the top surface to which they have become accustomed. Such users may add one or more inserts 14 under their old pillow, thus improving overall height while retaining a preferred or familiar top surface. FIG. 6 is a sectional view of the adjustable pillow 10 illustrated in FIG. 1, in combination with a conventional pillow 20. FIG. 6 shows that a conventional pillow can be inserted into the pillow case 12 through the open end 13. The stretchable opening 13 can be widened with a perpendicular zipper, that runs substantially the length of the pillow case 12. A wider opening allows for easier placement of insert(s) within the outer pillow case 12. The conventional pillow can be combined with one or various inserts 14. Thus, the invention provides maximum flexibility in obtaining the benefits of adjustable pillows and the utilization of conventional pillows.

ADVANTAGES OF THE INVENTION

The present invention provides an easily adjustable pillow case that provides different surface firmness and overall firmness and height across the entire sleeping area of the pillow case and also is compatible with conventional pillows to provide them with adjustability.

The present invention has been described above in terms of a presently preferred embodiment so that an understanding of the present invention can be conveyed. There are, however, many configurations for adjustable pillows not specifically described herein but with which the present invention is applicable. The present invention should therefore not be seen as limited to the particular embodiment described herein, but rather, it should be understood that the present invention has wide applicability with respect to adjustable pillows generally. All modifications, variations, or equivalent arrangements that are within the scope of the attached claims should therefore be considered within the scope of the invention.

I claim:

1. A pillow comprising:

a topmost layer comprising a first major surface;

a plurality of secondary layers with the topmost layer and the secondary layers being removably arranged in a stack; and a pillowcase formed separately from the topmost layer and the plurality of secondary layers, the pillowcase being disposed around the stack so that the pillowcase is in contact with the first major surface of the topmost layer, with the pillowcase being sufficiently stretchable to hold the stack together as a unit when all of the layers are present in the stack and also to hold the stack together as a unit when one of the secondary layers is removed from the stack.

2. The pillow of claim 1 wherein the pillowcase is sufficiently stretchable to hold the stack together as a unit when two of the secondary layers are removed from the stack.

3. The pillow of claim 1 wherein at least one of the plurality of secondary layers is a conventional pillow which has become permanently flat and permanently lost its height due to pressure.

4. The pillow of claim 1 wherein the pillowcase is sufficiently thin and pliable so that a firmness of the topmost layer will determine the surface firmness of the pillow.

5. The pillow of claim 1 wherein the pillowcase has no padding material.

6. The pillow of claim 1 wherein:

the first major surface of the topmost layer is substantially flat;

the topmost layer further comprises a substantially flat second major surface;

each of the plurality of secondary layers comprises two substantially flat major surfaces; and interfaces between adjacent layers of the removably arranged stack are formed by contact between substantially flat major surfaces.

7. The pillow of claim 1 wherein a firmness of the topmost layer is different than a firmness of each the plurality of secondary layers.

8. The pillow of claim 1 wherein the secondary layer which is adjacent to the topmost layer in the removably arranged stack has a secondary firmness is less firm than the topmost layer.

9. A method of adjusting the surface firmness of a pillow, the method comprising the steps of:

providing a pillow comprising:

an original topmost layer having an original firmness and a major surface;

at least one secondary layer, with the topmost layer and the at least one secondary layer being removably arranged in a stack; and a pillowcase disposed around the stack so that the pillowcase is in contact with the major surface of the original topmost layer, with the pillowcase being sufficiently thin and pliable so that a firmness of the topmost layer will determine a surface firmness of the pillow;

removing the original topmost layer from the stack and the pillowcase; and inserting a replacement topmost layer into the pillowcase in a topmost position in the stack, with the replacement topmost layer having a replacement firmness, and with the replacement firmness being different than the original firmness.

10. The method of claim 9 further comprising the step of comparing the surface firmness when the original topmost layer is in place to the surface firmness when the replacement topmost layer is in place to determine which surface firmness better accords with personal preferences of a user.

11. A method of using a pillow insert for an extended period, the method comprising the steps of:

providing an original pillow comprising an original layer and an original pillowcase;

resting on the original pillow at intervals until the original layer permanently becomes flat and permanently loses height due to pressure;

removing the original layer from the original pillowcase; and assembling a replacement pillow comprising:

the original layer;

a replacement layer; and a replacement pillowcase disposed around the original layer and the replacement layer.

12. The method of claim 1 further comprising the step of selecting the replacement pillowcase to be sufficiently stretchable to hold the original layer and the replacement layer together as a unit.

13. The method of claim 1 wherein the replacement pillow is assembled to further comprise at least one additional layer.

* * * * *